US005497721A

United States Patent [19]

Sulser et al.

[11] Patent Number: 5,497,721

[45] Date of Patent: Mar. 12, 1996

[54] SEWING MACHINE FOR GUIDING FABRIC TO BE SEWN AT A PRE-DETERMINED DISTANCE RELATIVE TO A STITCH-FORMING NEEDLE

[75] Inventors: René Sulser; Franz Rapold, both of Steckborn, Switzerland

[73] Assignee: Fritz Gegauf Aktiengesellschaft, Steckborn, Switzerland

[21] Appl. No.: 229,470

[22] Filed: Apr. 18, 1994

[30] Foreign Application Priority Data

Apr. 29, 1993 [CH] Switzerland ..... 01330/93

[51] Int. Cl.[6] ..... D05B 35/10

[52] U.S. Cl. ..... 112/153

[58] Field of Search ..... 112/153, 136, 112/152, 141, 143

[56] References Cited

U.S. PATENT DOCUMENTS

| | | | |
|---|---|---|---|
| 675,785 | 6/1901 | Moller | 112/153 |
| 764,180 | 7/1904 | Clarke | 112/153 |
| 1,547,965 | 7/1925 | Seybert | 112/153 |
| 2,711,704 | 6/1955 | Maczuga et al. | 112/153 |
| 4,572,090 | 2/1986 | Hanyu et al. | 112/153 |

*Primary Examiner*—Peter Nerbun
*Attorney, Agent, or Firm*—Edwin D. Schindler

[57] ABSTRACT

A sewing machine is disclosed having an arrangement for guiding a fabric to be sewn at an adjustable distance with respect to a stitch-forming sewing needle and having a guide rail in which the guide rail is capable of being removably affixed to the working surface. The guide rail is provided with a retaining part, which is C-shaped in its cross-section, and has a rib-shaped guide cam. The retaining part is preferably provided at a front-side end of the guide rail of the sewing machine and at a right angle to its guide beams. The retaining part is constructed so that the rib-shaped guide cam can engage a slot which is formed underneath the working surface.

28 Claims, 3 Drawing Sheets

SEWING MACHINE FOR GUIDING FABRIC TO BE SEWN AT A PRE-DETERMINED DISTANCE RELATIVE TO A STITCH-FORMING NEEDLE

BACKGROUND OF THE INVENTION

1. Technical Field of the Invention

The present invention relates to a sewing machine with an arrangement for guiding fabric to be sewn at a pre-determined distance relative to a stitch-forming needle.

More particularly, the present invention relates to a sewing machine having an arrangement for guiding fabric to be sewn, with respect to the sewing needle, with said arrangement being capable of attachment to the sewing machine without the use of tools and whose distance from the sewing needle is adjustable with a high degree of precision.

2. Description of the Prior Art

Various means for guiding the edge of a fabric to be sewn are known to the prior art.

U.S. Pat. No. 675,785, issued Jun. 4, 1901, for example, discloses an edge guidance apparatus which is held on a measuring rule attached to a working surface of the sewing machine in a manner capable of being shifted lengthwise and of being locked. In this apparatus, the measuring rule projects beyond the working surface and interferes with the through-guidance of the fabric to be sewn.

U.S. Pat. No. 4,572,090, issued Feb. 25, 1986, discloses another edge guidance apparatus which consists of a U-shaped stirrup, the legs of which are directed slightly inwards and the ends of which feature a mutual distance that is less than the width of the working surface, e.g., the free arm or the extension table of the sewing machine. The base of the U-shaped stirrup, when in its "stuck-on" position, lies on the working surface and runs parallel to the feed direction of the fabric to be sewn. The distance between the base legs of the stirrup and the sewing needle is adjusted by means of manual shifting of the stirrup on the working surface. The amount of the distance must be adjusted by means of measuring or by feel. A reproducible adjustment without additional measuring is not possible. Furthermore, a shift caused by the unintended sliding of the stirrup on the working surface may not be checked without once again using a measuring rule.

For the sewing of circular-shaped seams, accessory parts for sewing machines can be bought, which parts may be attached to the working surface at the opening for the passage of the fabric feeder through said working surface, which parts feature an arbor which projects upwards out from the working surface. The distance of the arbor from the needle is capable of adjustment.

SUMMARY OF THE INVENTION

It is an object of the present invention to provide a sewing machine having an arrangement for the guidance of fabric to be sewn, with respect to a sewing needle, which arrangement can be attached to the sewing machine without the use of tools.

It is a further object of the present invention to provide a sewing machine having an arrangement for the guidance of fabric to be sewn wherein said arrangement provides for a precise adjustment of the location of the needle.

It is a further object of the present invention to provide an arrangement for fabric to be sewn which allows for a precise adjustment of the sewing needle without the need for using a measuring rule and which generally overcomes the disadvantages inherent in prior art devices.

The foregoing and related objects are achieved by the present invention wherein a sewing machine is provided with an arrangement, or means, for guiding a fabric to be sewn at an adjustable distance with respect to a stitch-forming sewing needle and a guide rail in which the guide rail, which is capable of being removably affixed to the working surface, is provided with a retaining part, which is C-shaped in its cross-section, and with a rib-shaped guide cam. The retaining part is preferably provided at a front-side end of the guide rail of the sewing machine and at a right angle to its guide beams. The retaining part is constructed so that it includes means for engaging (e.g., the rib-shaped guide cam) a slot which is formed underneath the working surface.

The arrangement according to the present invention can be attached to the sewing machine, in a manner essentially devoid of clearance, by being pushed from the front side into a slot-shaped sliding guide. Both when sewing with this arrangement, as well as without it, there are no attachment elements on the working surface of the sewing machine which could interfere with the feed of the fabric to be sewn. The arrangement, i.e., guidance means, engages by means of guide cams into a slot in the sliding guide, the latter being arranged on the underside of the working surface, close to the latter's lengthwise edge in a manner such that no dirt can accumulate in the slot. The scale for the adjustment of the distance of the arrangement from the needle may be recessed, hot-pressed, stenciled, or glued onto the working surface and may be arranged on the latter either on top or on the front side. The scale may extend from the needle center towards the left and right in a manner such that the guidance of the fabric to be sewn, both to the left and to the right of the needle, is possible. By means of appropriate dimensioning of the guide cam, the arrangement may be shifted along the working surface only by overcoming resistance. The latter is sufficiently great to prevent an unintended shifting during sewing.

The arrangement according to the invention may be attached both to free-arm, as well as to flat-bed sewing machines, and to table extensions. In the case of free-arm sewing machines with an extension table, the same guidance means may be used on both the free-arm and on the extension table arrangements. In order to ensure that the centering arbor comes to lie laterally to the sewing needle, either when the arrangement is used directly on the free arm or when using it on an extension table, appropriately arranged accommodations are recessed-in for the arbor.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
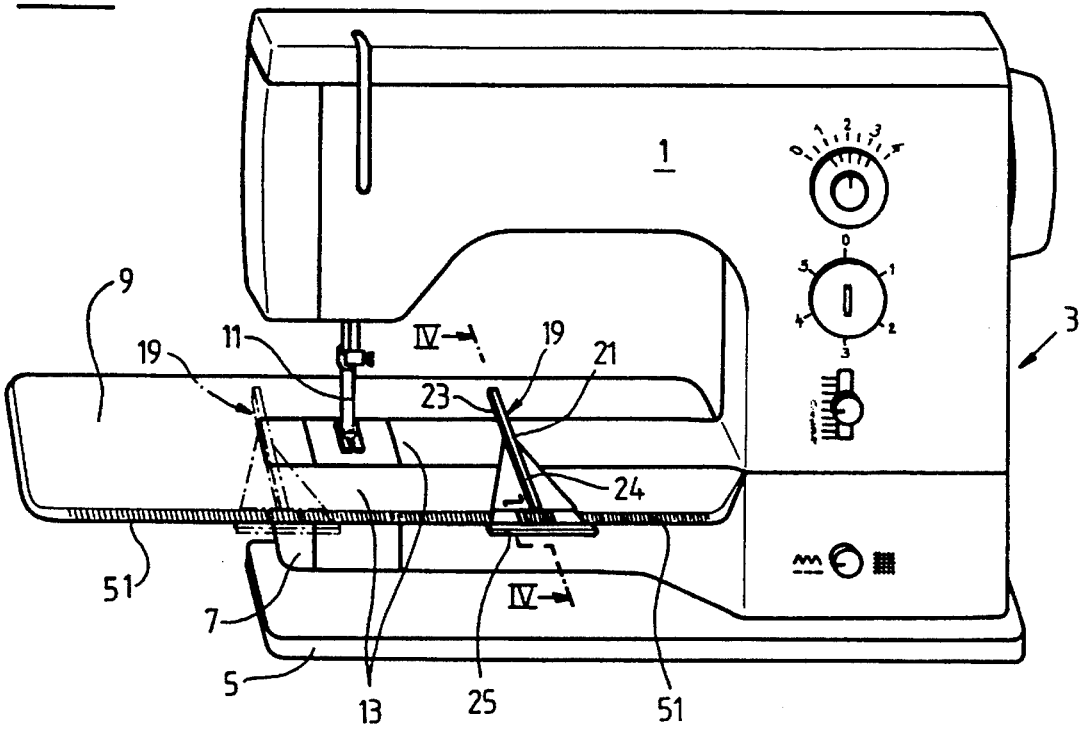
FIG. 1 is a schematic representation of a free-arm sewing machine with a stuck-on extension table.

Turning now, in detail, to a description of the drawing figures and preferred embodiments, in FIG. 1 there is represented a conventional free-arm sewing machine 1 with a machine housing 3 and a base plate 5, with the free arm 7 and with an extension table 9, which is pushed onto the free arm 7. Reference numeral 11 designates the sewing needle and reference numeral 13 designates the working surface. Underneath the needle 11, the stitch hole 15 and the fabric feeder 17 may be seen.

Figure 2:
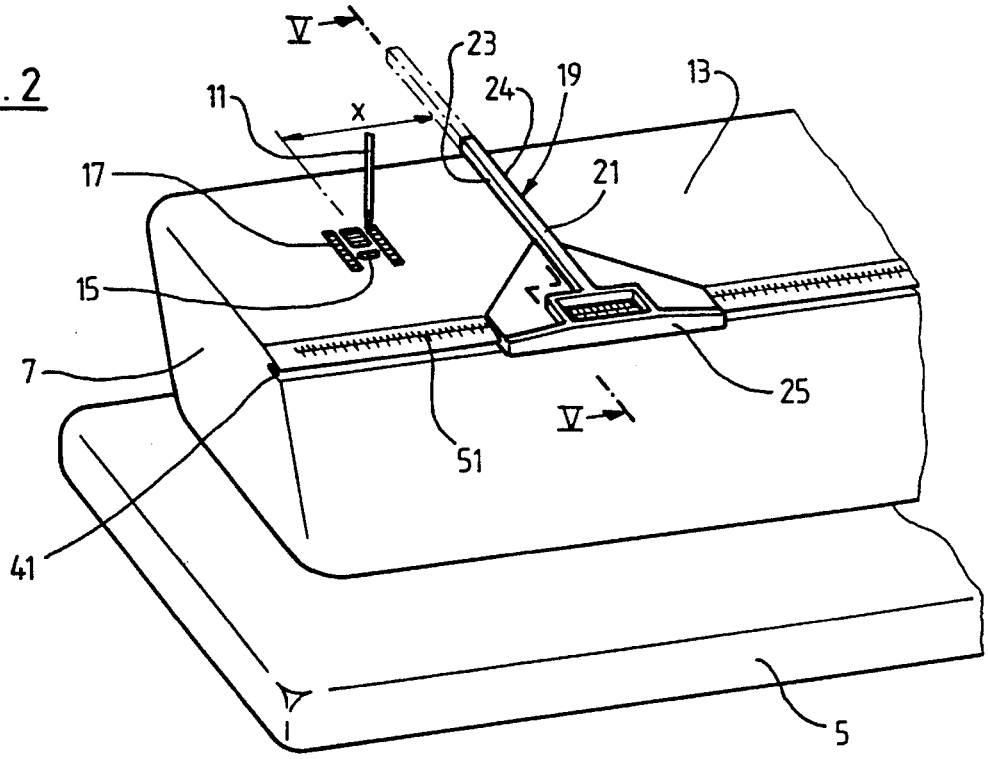
FIG. 2 is a partial, perspective view of the free-arm of a sewing machine without an extension table.
Figure 3:
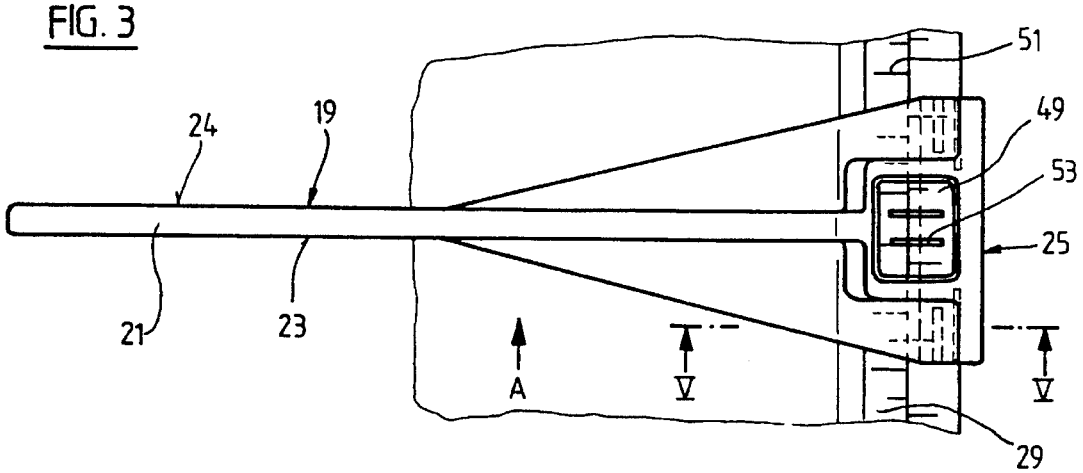
FIG. 3 is a top view of an arrangement for edge guidance.

In FIG. 2, the free arm 7 may be seen without the stuck-on extension table 9.

On the extension table 9 and/or on the free arm 7, one can see a T-shaped guide rail 19, preferably made of a synthetic material, which guide rail features a guide beam 21 with guide edges 23, 24 arranged on both sides, and with a retaining part 25, which has a C-shaped cross-section and lies at right angles to the guide edges 23, 24. The underside 26 of the guide beam 21, which underside is intended to lie on the working surface 13, is made in a plane design and, in order to improve the legibility of the measuring rule, may feature an inclined edge section 29, to which corresponds an appropriately inclined section 27 on the lengthwise edge of the working surface 13. The C-shaped retaining part 25 envelopes the lengthwise edge of the working surface 13 in a clamp-type fashion, in a manner such that a guide part 31, which projects vertically downwards, abuts in front against the lengthwise edge of the free arm 7 and/or against the lengthwise edge 33 of the extension table 9. The leg 35 of the retaining part 25, which leg engages under the working surface 13, is equipped with a rib-shaped guide cam 37, which cam engages into a guide slot 39, on the underside of the extension table 9, and/or into a recess 41 in the free arm 7, which is open towards the front side and is attached to the underside of the extension table 9. The guide cam 37 is preferably designed in two parts and comprises two ribs 38 which are arranged (forming an acute angle alpha with respect to the inner edge 43 of the guide part 31) on sections 47 of the leg 35; the sections are designed in an elastic fashion by means of notches 45 (see, FIG. 6.)

The arrangement of the ribs 38, running at an acute angle to the inner edge 43, causes a tensioning of the guide cam 37 in the guide slot 39, in a manner so as to generate the resistance which prevents the unintended shifting of the guide rail 19. This tensioning can also be achieved by a different construction of the guide cam 37 or by a spring action (not shown.)

Figure 4:
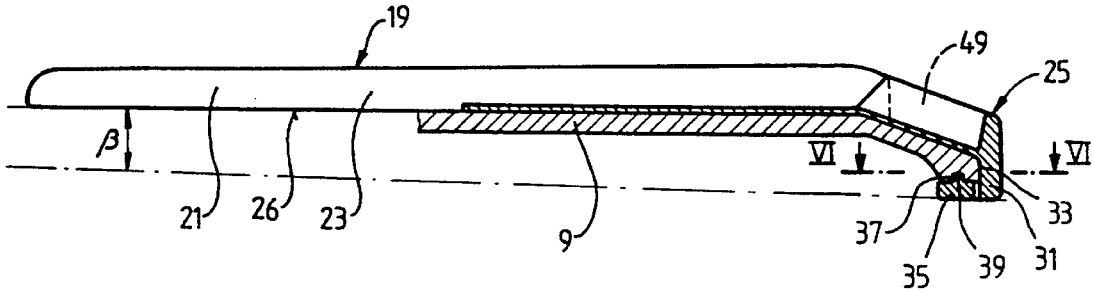
FIG. 4 is a lateral view of the arrangement for edge guidance, as seen from the direction "A" of an extension table, drawn in section.
Figure 5:
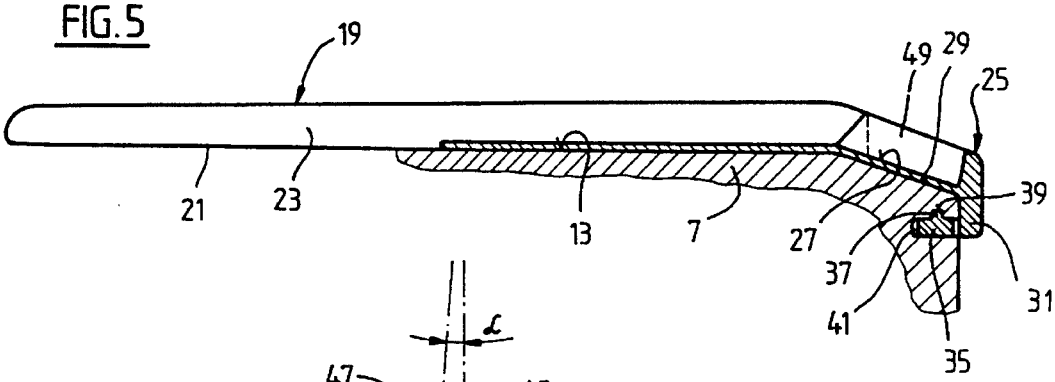
FIG. 5 is a lengthwise cross-sectional view, taken along the V—V line in FIG. 3, on a free arm.

In order to have the guide beam 21 of the guide rail 19 abut elastically against the working surface 13, the beam features a slight pre-tensioning with respect to the retaining part 25, the pre-tensioning being produced by having the supporting surface 26 (which abuts against the working surface 13) run at an acute angle beta (see, FIG. 4) with respect to the retaining part 25.

Figure 7:
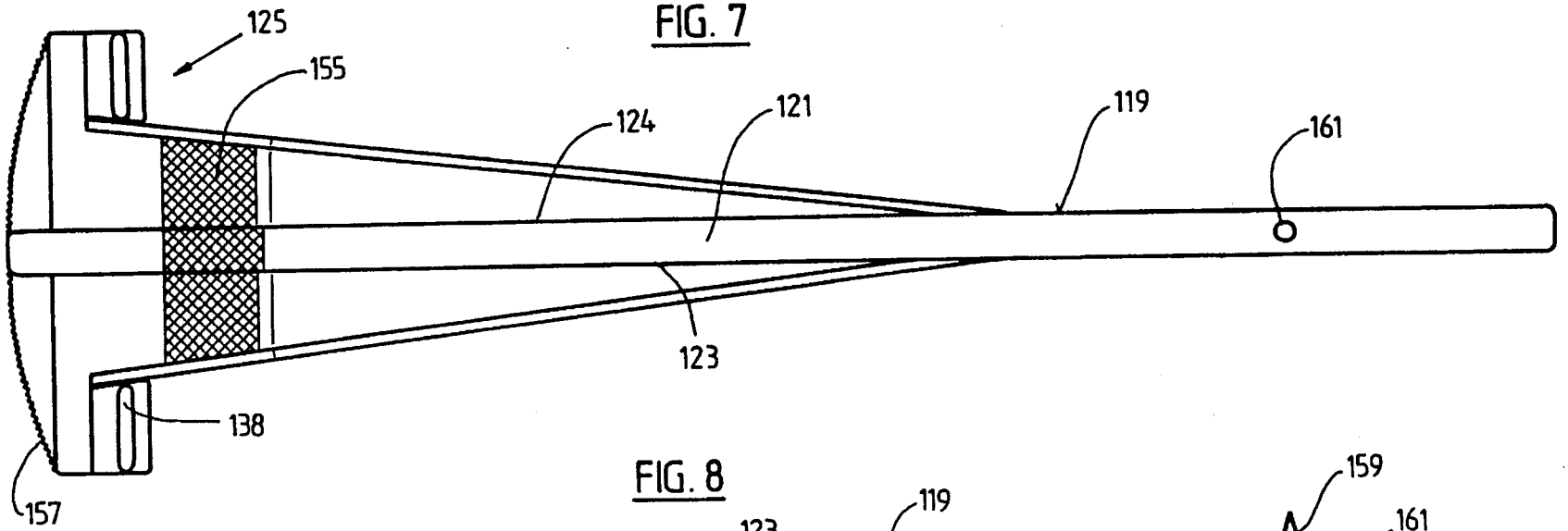
FIG. 7 is a top view of a further preferred embodiment of an arrangement for the guidance of fabric to be sewn, which has a recess for a centering arbor.
Figure 8:
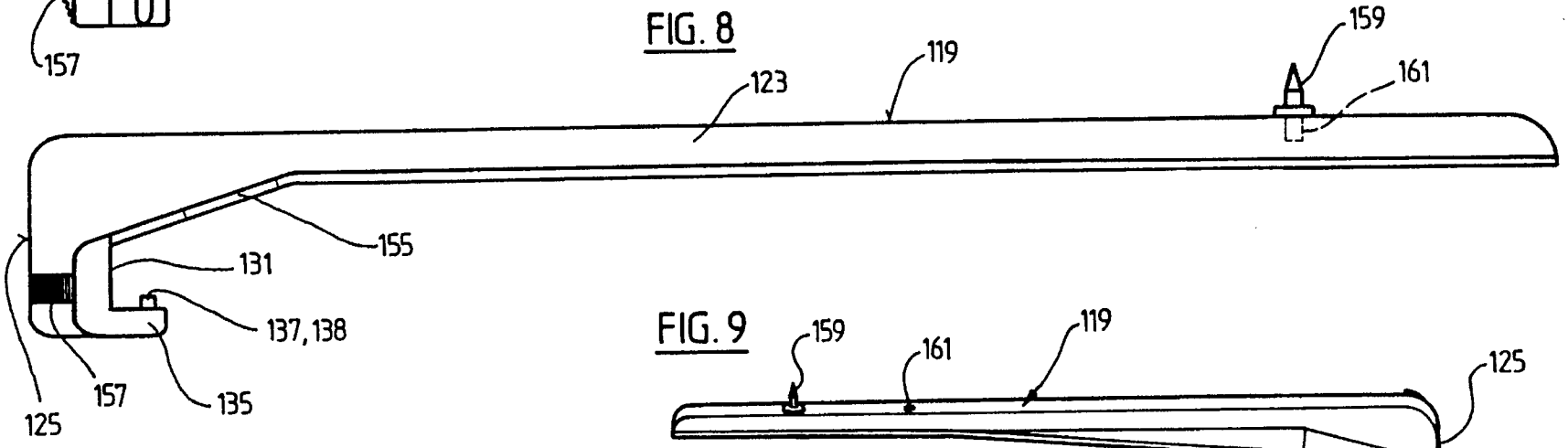
FIG. 8 is a lateral view of the arrangement of FIG. 7 with an inset centering arbor; and, FIG. 9 is a perspective view of the guidance arrangement.
Figure 9:
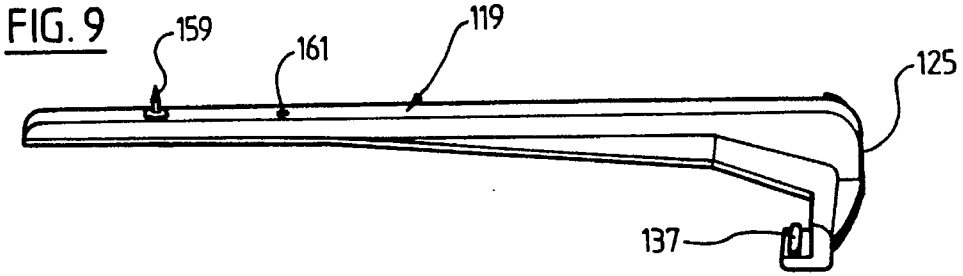

A window 49 is cut into the retaining part 25, which window permits a through-view, across the retaining part 25, of a scale 51 on the free arm 7 and/or on extension table 9. Into the window 49 (which can be covered by a transparent plate) is recessed at least one positioning line or thread 53, for positioning the guide edges 23, 24 at a distance x with respect to the stitch-forming needle 11. It will be obvious to the skilled artisan that, in lieu of using window 49, the entire guide rail and/or the retaining part 25 could be made out a transparent synthetic material of low elasticity. A corresponding embodiment is shown in FIGS. 7–9. In that embodiment, the guide edges 123, 124 (which are extended beyond the retaining part 125) serve as indexing means with respect to the scale 51 on the sewing machine 1.

In order to facilitate the through-view of the scale 51, the region 155 of the guide rail 119 (which region lies above the scale) is polished to a high sheen. In FIGS. 7 and 8, this region 155 is indicated by double-cross hatching. In these two figures, one can also readily see the legs 135, with the guide cams 137 and/or ribs 138 arranged on those legs. In order to improve the ease of operation, i.e., in order to facilitate shifting, vertically running grooves 157 may be applied.

A centering arbor 159 may be set upon the surface of the guide beam 121, which arbor is held in a recess 161 in the guide beam 121. It is also possible to use several recesses 161 on the guide beam 121, in order to use the guide rail 119 both directly on the free arm 7 of the sewing machine 1 and on an extension table 9. The fabric to be sewn can be stuck upon the centering arbor 159, in a manner such that a circular seam may be produced. It will be obvious to those skilled in the art that if guide rail 119 is only needed to produce circular-shaped seams, the design of the vertically lying guide edges 123 and 124 may be dispensed with. In that case, the guide rail 119 can be designed in a flatter manner, whereby a lesser resistance against the rotation of the fabric to be sewn around the arbor 159 is achieved.

The scale 51 of the measuring rule on the free arm 7 and/or on the extension table 9 may be applied there in a known manner, by recessed injection molding, hot pressing, stenciling or by printing onto an adhesive tape and gluing the latter onto it. The scale may feature both millimetric and inch divisions and may be applied on top or on a side.

Figure 6:
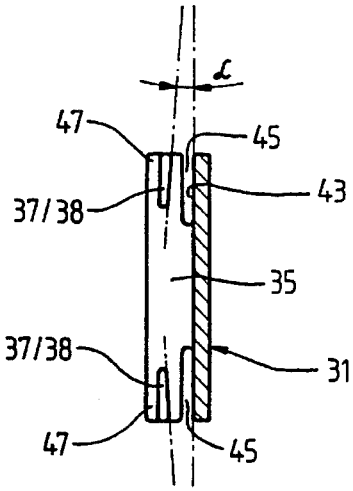
FIG. 6 is a cross-sectional view taken along the VI—VI line in FIG. 4.

As an alternative to the self-locking of the guide rail 19, as shown and described in FIG. 6, it is also possible to use an eccentric clamping arrangement, as used with slide calipers.

Normally, the guide rail 19, 119 is attached to the sewing machine 1 in a conventional manner, as it is needed. For such purpose, it is pushed inward from the front side of the free arm 7 into the recess 41 and brought to the desired distance with respect to needle 11. In an analogous manner, the guide rail 19, 119 is attached to the extension table 9. There again, the guide rail 19 is pushed from the front side into the guide slot 39 on the underside of the extension table 9 and is placed into the proper position.

While only several embodiments of the present invention have been shown and described, it will be obvious to those skilled in the art that many modifications may be made to the present invention without departing from the spirit and scope thereof.

What is claimed is:

1. A sewing machine having an arrangement for guiding fabric to be sewn at an adjustable distance relative to a stitch-forming needle, said sewing machine comprising:

a working surface with a slot formed underneath said working surface., the slot of said working surface being arranged in a recess which is open on a front side and runs lengthwise in said working surface;

a stitch-forming needle;

a retaining part being C-shaped in its cross-section and having a rib-shaped guide cam, said rib-shaped guide cam engaging the slot formed underneath said working surface;

a guide rail having beam guide beam said guide rail at a front-side end, being attached to said retaining part at a right angle thereto; and, a scale for adjusting a distance between said guide rail and said stitch-forming needle.

2. The sewing machine according to claim 1, wherein said retaining part has attached thereon, in an angled position, a leg, with said rib-shaped guide cam sitting on said leg which is arranged on a guide part.

3. The sewing machine according to claim 2, wherein said ribbed-shaped guide cam comprises two distanced ribs which are arranged at an acute angle with respect to an inner edge of said guide part.

4. The sewing machine according to claim 3, wherein lateral regions of said leg of said retaining part are connected in an elastic spring-action manner with said guide part, said lateral regions sitting on said two distanced ribs.

5. The sewing machine according to claim 4, wherein said leg, in the lateral region of said two distanced ribs, is separated from said guide part by slits.

6. The sewing machine according to claim 1, wherein in said retaining part there is arranged a window with a positioning line for an adjustment of said guide rail with respect to said scale.

7. The sewing machine according to claim 1, wherein in said retaining part there is arranged a window with a transparent plate on said window and a positioning line applied to said transparent plate for an adjustment of said guide rail with respect to said scale.

8. The sewing machine according to claim 1, wherein said guide beams have lateral edges which project beyond a surface of said retaining part for serving as positioning lines.

9. The sewing machine according to claim 1, wherein said guide beam has lateral edges which are constructed as a guide stop for an edge of the fabric to be sewn.

10. The sewing machine according to claim 1, wherein on said guide beam there is arranged a centering arbor which projects upwardly.

11. The sewing machine according to claim 10, wherein said centering arbor is capable of being stuck into said guide beam.

12. The sewing machine according to claim 10, wherein said centering arbor is rigidly connected with said guide beam.

13. The sewing machine according to claim 1, wherein said working surface is a free arm.

14. The sewing machine according to claim 1, wherein said working surface is an extension table.

15. A sewing machine having an arrangement for guiding fabric to be sewn at an adjustable distance relative to a stitch-forming needle, said sewing machine comprising:

a working surface with a slot formed underneath said working surface, the slot of said working surface being arranged in a recess which is open on a rear side and runs lengthwise in said working surface;

a stitch-forming needle;

a retaining part being C-shaped in its cross-section and having a rib-shaped guide cam, said rib-shaped guide cam engaging the slot formed underneath said working surface;

a guide rail having a guide beam, said guide rail at a front-side end, being attached to said retaining part at a right angle thereto; and, a scale for adjusting a distance between said guide rail and said stitch-forming needle.

16. The sewing machine according to claim 15, wherein said retaining part has attached thereon, in an angled position, a leg, with said rib-shaped guide cam sitting on said leg which is arranged on a guide part.

17. The sewing machine according to claim 16, wherein said ribbed-shaped guide cam comprises two distanced ribs which are arranged at an acute angle with respect to an inner edge of said guide part.

18. The sewing machine according to claim 17, wherein lateral regions of said leg of said retaining part are connected in an elastic spring-action manner with said guide part, said lateral regions sitting on said two distanced ribs.

19. The sewing machine according to claim 18, wherein said leg, in the lateral region of said two distanced ribs, is separated from said guide part by slits.

20. The sewing machine according to claim 15, wherein in said retaining part there is arranged a window with a positioning line for an adjustment of said guide rail with respect to said scale.

21. The sewing machine according to claim 15, wherein in said retaining part there is arranged a window with a transparent plate on said window and a positioning line applied to said transparent plate for an adjustment of said guide rail with respect to said scale.

22. The sewing machine according to claim 15, wherein said guide beams have lateral edges which project beyond a surface of said retaining part for serving as positioning lines.

23. The sewing machine according to claim 15, wherein said guide beam has lateral edges which are constructed as a guide stop for an edge of the fabric to be sewn.

24. The sewing machine according to claim 15, wherein on said guide beam there is arranged a centering arbor which projects upwardly.

25. The sewing machine according to claim 24, wherein said centering arbor is capable of being stuck into said guide beam.

26. The sewing machine according to claim 24, wherein said centering arbor is rigidly connected with said guide beam.

27. The sewing machine according to claim 15, wherein said working surface is a free arm.

28. The sewing machine according to claim 15, wherein said working surface is an extension table.

* * * * *